US006126437A

United States Patent [19]

Lixiang et al.

[11] Patent Number: 6,126,437

[45] Date of Patent: Oct. 3, 2000

[54] IGNITER WITH A SAFETY SWITCH

[75] Inventors: Mao Lixiang; Li Dongliang, both of Zhejiang, China

[73] Assignee: Cixi No. 9 Radio Factory, Zhejiang, China

[21] Appl. No.: 09/361,947

[22] Filed: Jul. 27, 1999

[30] Foreign Application Priority Data

Dec. 11, 1998 [CN] China ..... 98247274

[51] Int. Cl.[7] ..... F23D 11/36

[52] U.S. Cl. ..... 431/153; 431/255

[58] Field of Search ..... 431/153, 255, 431/277

[56] References Cited

U.S. PATENT DOCUMENTS

| | | | |
|---|---|---|---|
| 4,832,596 | 5/1989 | Morris, Sr. | 431/153 |
| 4,859,172 | 8/1989 | Nitta . | |
| 4,904,180 | 2/1990 | Nitta . | |
| 5,074,781 | 12/1991 | Fujita | 431/153 |
| 5,356,286 | 10/1994 | Sher | 431/153 |
| 5,409,372 | 4/1995 | Nobuo | 431/153 |
| 5,417,563 | 5/1995 | Cirami | 431/153 |
| 5,462,432 | 10/1995 | Kim . | |
| 5,607,295 | 3/1997 | Khemarangsan | 431/153 |
| 5,788,474 | 8/1998 | Chung et al. | 431/153 |
| 5,788,476 | 8/1998 | Sher . | |
| 5,829,963 | 11/1998 | Ichikawa . | |
| 5,833,448 | 11/1998 | Doucet et al. . | |
| 5,854,530 | 12/1998 | LaForest et al. . | |
| 5,885,069 | 3/1999 | Rogelet . | |
| 5,980,242 | 11/1999 | Man | 431/153 |

*Primary Examiner*—Carl D. Price
*Attorney, Agent, or Firm*—Alston & Bird LLP

[57] ABSTRACT

An igniter with a safety switch having a barrel, a case, and a switch button, is characterized in that the igniter also comprises a rotation shaft with a torsional spring, a substantially Z-shaped safety lock, with one of its ends remaining outside the case and the other end located below the corresponding position of lateral convex of the switch button. In natural state, the switch button cannot be pressed down because of the prevention of the safety lock, and when safety lock is turned on, its head moves away from lateral convex that corresponds with switch button, and then safety lock can be normally pressed down to achieve ignition. The present invention enhances the safety property of the igniter and is simple-structured and easy to operate.

5 Claims, 2 Drawing Sheets

IGNITER WITH A SAFETY SWITCH

FIELD OF THE INVENTION

The present invention relates to an igniter, particularly to an igniter with a safety unit.

BACKGROUND OF THE INVENTION

With the improvement of the living standard and the development of technology, matches have been taken place by igniters in lighting domestic gas cookers. However, a conventional igniter does not have a safety unit and thus has the potential of causing danger when children happen to play with it.

SUMMARY OF THE INVENTION

The object of present invention is to provide an igniter with a safety unit to solve the above-mentioned problems.

In accordance to the object of present invention, there is provided an improved igniter with a safety lock. It has a barrel extended from a case, and a switch button. The igniter has a substantially Z-shaped movable safety lock. A torsional spring is mounted on the rotation shaft of the safety lock. One end of the Z-shaped safety lock protrudes outside of the case, while the other end is situated below the lateral convex of the switch button. In natural order, the switch button can not be pressed down because of the end of the safety lock situated below the lateral convex of the switch button. And when the safety lock is turned on, its head moves away from the lateral convex that corresponds to the switch button, thus the switch button can be normally pressed down and ignition can be achieved.

The present invention effectively enhances the safety property of the conventional igniters and is simple in structure and convenient in operation; therefore, it is a preferable upgrading of the conventional igniters.

DETAILED DESCRIPTION OF THE INVENTION

Below is a detailed description of the present invention with reference to the drawings.

Figure 1:
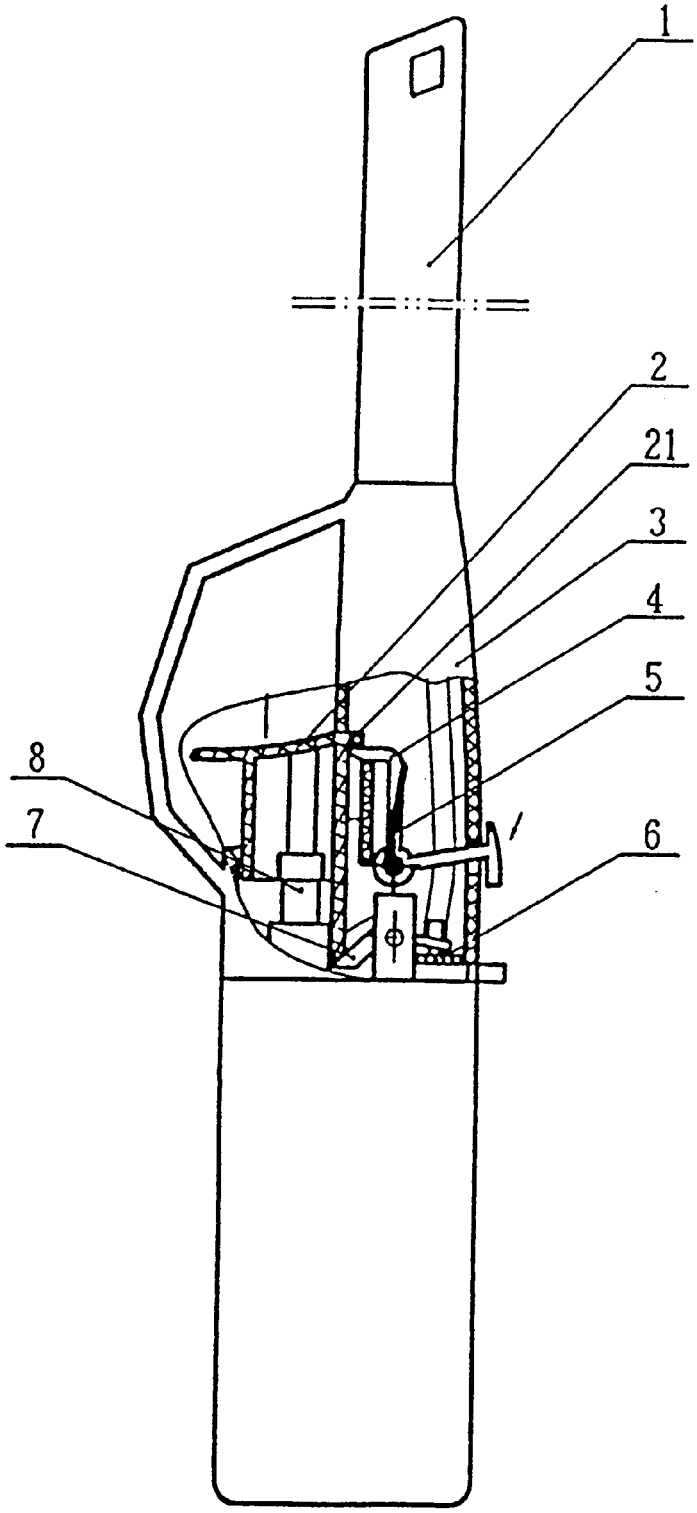
FIG. 1 is a block diagram of an embodiment of present invention.
Figure 2:
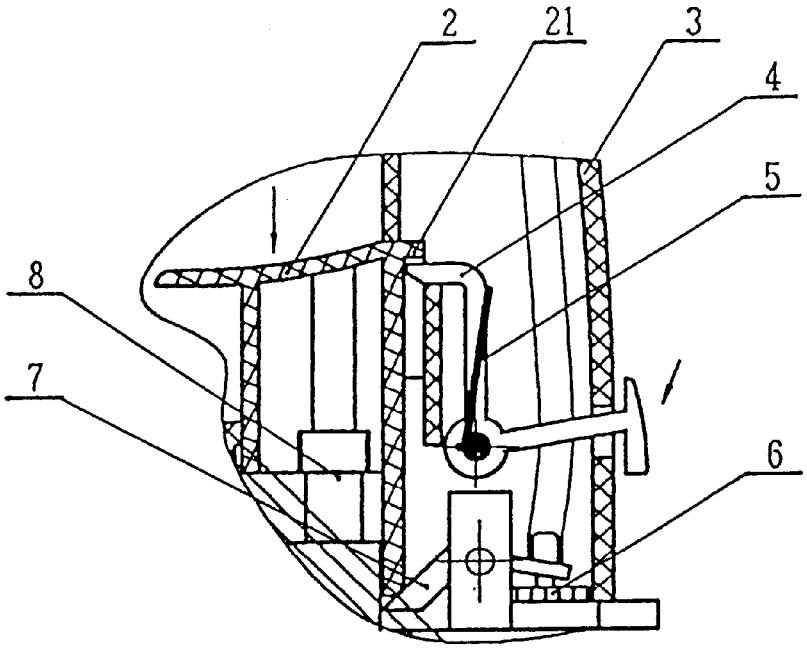
FIG. 2 is a partial enlarged view of FIG. 1.
Figure 3:
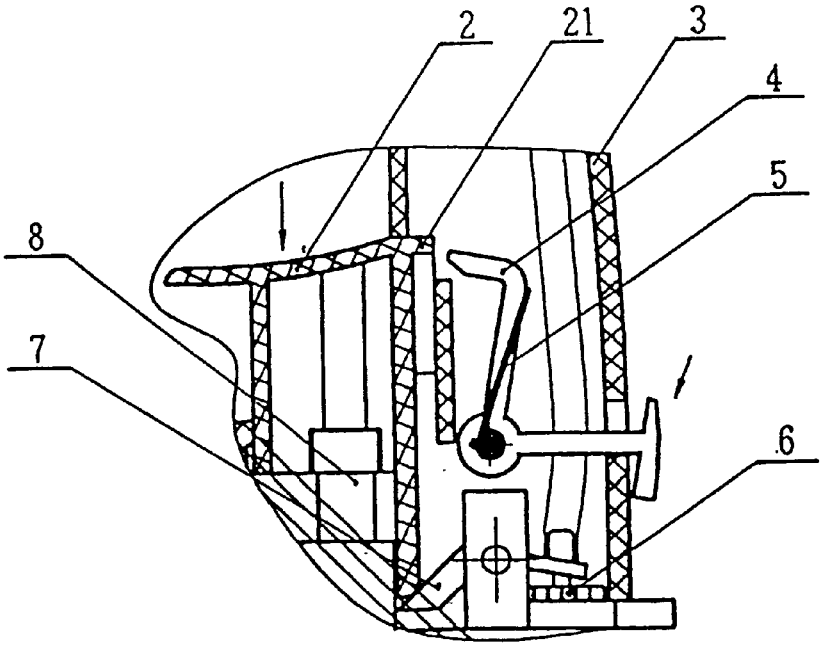
FIG. 3 is a partial enlarged view of the safety switch when it is pressed down.

As shown in FIG. 1, 1 is a barrel, 2 is a switch button, 3 is a case, 4 is a safety lock, 5 is a torsional spring, 6 is an air valve, 7 is a bridging piece, and 8 is a piezoelectric device. A substantially Z-shaped safety lock 4 has two end portions and a middle portion. One end portion is located beneath the lateral convex 21 of switch button 2 as shown in FIGS. 1–3. The other end of safety lock 4 protrudes from case 3 to be exposed to outside of case 3 so that a user can switch the safety lock by pressing or moving this protruding end. In natural state, switch button 2 cannot be pressed down because of the prevention of safety lock 4, as is shown in FIG. 2. When safety lock 4 is turned on, the end beneath lateral convex 21 then moves away from lateral convex 21 that corresponds with switch button 2; therefore, switch button 2 can be pressed down to achieve ignition. After ignition is completed, safety lock 4 will reset under the force of torsional spring 5 when switch button 2 and safety lock 4 are released, and safety lock 4 will be restored to the locked position.

What is claimed is:

1. An igniter having a barrel extending from a case, said igniter comprising:

a switch button having a finger support and an extended convex portion capable of moving along a path from a first position to a second position, said extended convex portion being located within said case, said finger support protruding from a first side of the case; and a substantially Z-shaped safety lock mounted for pivoting about an axis that is generally perpendicular to the path and having a body portion connecting first and second arms, said first arm being adjacent to said extended convex portion and preventing said extended convex portion from moving from said first position to said second position, said second arm protruding from a substantially opposite side of the case to the first side, wherein said first arm is capable of being moved away from said extended convex portion by pivotably moving said second arm thus allowing said extended convex portion to move to said second position to ignite the igniter.

2. The igniter of claim 1, wherein the igniter further comprises a torsional spring associated with said safety lock for maintaining said first arm adjacent to said extended convex portion so as to prevent said extended convex portion from moving from said first position to said second position.

3. The igniter of claim 1, wherein said safety lock is mounted for pivoting at a joint formed between said body portion and said second arm.

4. The igniter of claim 1, wherein said safety lock consists essentially of said body portion, said first and second arms, and a torsional spring operably mounted on said first arm.

5. The igniter of claim 1, further comprising a guard operably connected to the first side of the case and shielding said finger support.

* * * * *